US006136273A

United States Patent [19]

Seguin et al.

[11] Patent Number: 6,136,273

[45] Date of Patent: Oct. 24, 2000

[54] CLOSURE DEVICE FOR LABORATORY RECEPTACLES

[75] Inventors: Daniel J. Seguin, Amherst; Margaret M. Banar, Manchester, both of N.H.

[73] Assignee: Matrix Technologies Corporation, Hudson, N.H.

[21] Appl. No.: 09/195,326

[22] Filed: Nov. 18, 1998

[51] Int. Cl.[7] ..... B01L 3/00; B65D 43/04

[52] U.S. Cl. ..... 422/99; 422/102; 422/104; 206/443; 215/35; 220/801

[58] Field of Search ..... 422/99, 102, 103, 422/104; 215/230, 355, 796, 801; 206/443

[56] References Cited

U.S. PATENT DOCUMENTS

| | | | |
|---|---|---|---|
| 3,302,854 | 2/1967 | Midgley et al. | 229/43 |
| 3,442,377 | 5/1969 | Angelus | 206/65 |
| 3,539,071 | 11/1970 | Ludder | 220/23.4 |
| 3,895,456 | 7/1975 | Fabre | 46/30 |
| 3,900,122 | 8/1975 | Dichter | 215/31 |
| 4,126,223 | 11/1978 | Griffin | 206/445 |
| 4,599,314 | 7/1986 | Shami | 435/287 |
| 4,636,477 | 1/1987 | Ronka et al. | 436/48 |
| 4,675,299 | 6/1987 | Witty et al. | 436/165 |
| 4,834,247 | 5/1989 | Oshima et al. | 206/631 |
| 4,960,219 | 10/1990 | Jordan et al. | 215/354 |
| 5,005,721 | 4/1991 | Jordan | 220/23.4 |
| 5,110,556 | 5/1992 | Lyman et al. | 422/101 |
| 5,112,574 | 5/1992 | Horton | 422/102 |
| 5,282,543 | 2/1994 | Picozza et al. | 220/255 |
| 5,377,853 | 1/1995 | Papciak | 215/230 |
| 5,379,907 | 1/1995 | Niedospial et al. | 215/247 |
| 5,431,280 | 7/1995 | Bryant | 206/363 |
| 5,544,778 | 8/1996 | Goncalves | 220/23.4 |
| 5,554,536 | 9/1996 | Rising | 435/305.1 |
| 5,587,321 | 12/1996 | Smith et al. | 435/305.3 |
| 5,609,827 | 3/1997 | Russell et al. | 422/102 |
| 5,702,017 | 12/1997 | Goncalves | 220/23.4 |
| 5,780,294 | 7/1998 | Stevens et al. | 435/297.5 |
| 5,789,251 | 8/1998 | Astle | 436/48 |
| 5,801,055 | 9/1998 | Henderson | 435/297.5 |
| 5,817,510 | 10/1998 | Pandey et al. | 435/305.3 |
| 5,839,592 | 11/1998 | Hayes | 215/230 |

*Primary Examiner*—Randy Golakowski
*Assistant Examiner*—Anita Alanko
*Attorney, Agent, or Firm*—Samuels, Gauthier & Stevens

[57] ABSTRACT

A closure device is provided which includes a flexible cover with an array of protruding hollow caps which are formed integrally with and depend from the cover. The caps have cup shaped noses with cylindrical side walls joined to the cover by inwardly tapered intermediate wall sections. The caps form a friction fit with an array of mutually spaced receptacles, for example test tubes, deep well blocks or microwell plates.

17 Claims, 4 Drawing Sheets

CLOSURE DEVICE FOR LABORATORY RECEPTACLES

BACKGROUND OF THE INVENTION

1. Field of the Invention

This invention is directed to cap mats, cap strips and other like closure devices for plural laboratory receptacles such as test tubes, blocks and the like.

2. Description of the Prior Art

Various closure devices have been developed to seal test tubes and blocks. Some are relatively easy to apply and remove, but lack adequate sealing capability. Others provide a satisfactory seal but are extremely difficult to apply and remove, sometimes resulting in splashing and cross contamination of specimens contained in the receptacles. Additional drawbacks of conventional closure devices include an inability to function satisfactorily at elevated or reduced temperatures, and seal failures at differential pressures on the order of 0.5 atmospheres and below.

The objective of the present invention is to provide a closure device which is not only relatively easy to apply and remove, but which is also capable of achieving a satisfactory seal under even the most demanding conditions normally encountered in the handling and transport of laboratory specimens.

SUMMARY OF THE INVENTION

A closure device in accordance with the present invention includes a flexible cover, in either mat or strip form, configured and dimensioned to overlie a plurality of laboratory receptacles, e.g., test tubes, deep well blocks, microwell plates, etc. An array of hollow caps is formed integrally with and depends from the cover. The caps are positioned to enter the open ends of the receptacles with an interference fit, each cap having a relatively blunt shaped nose joined to the cover by an intermediate wall section having an inwardly tapering outer surface.

BRIEF DESCRIPTION OF THE DRAWINGS

Other objects, features and advantages of the present invention will become apparent in light of the following detailed description in connection with the accompanying drawings, wherein.

DETAILED DESCRIPTION OF PREFERRED EMBODIMENT

Figure 1:
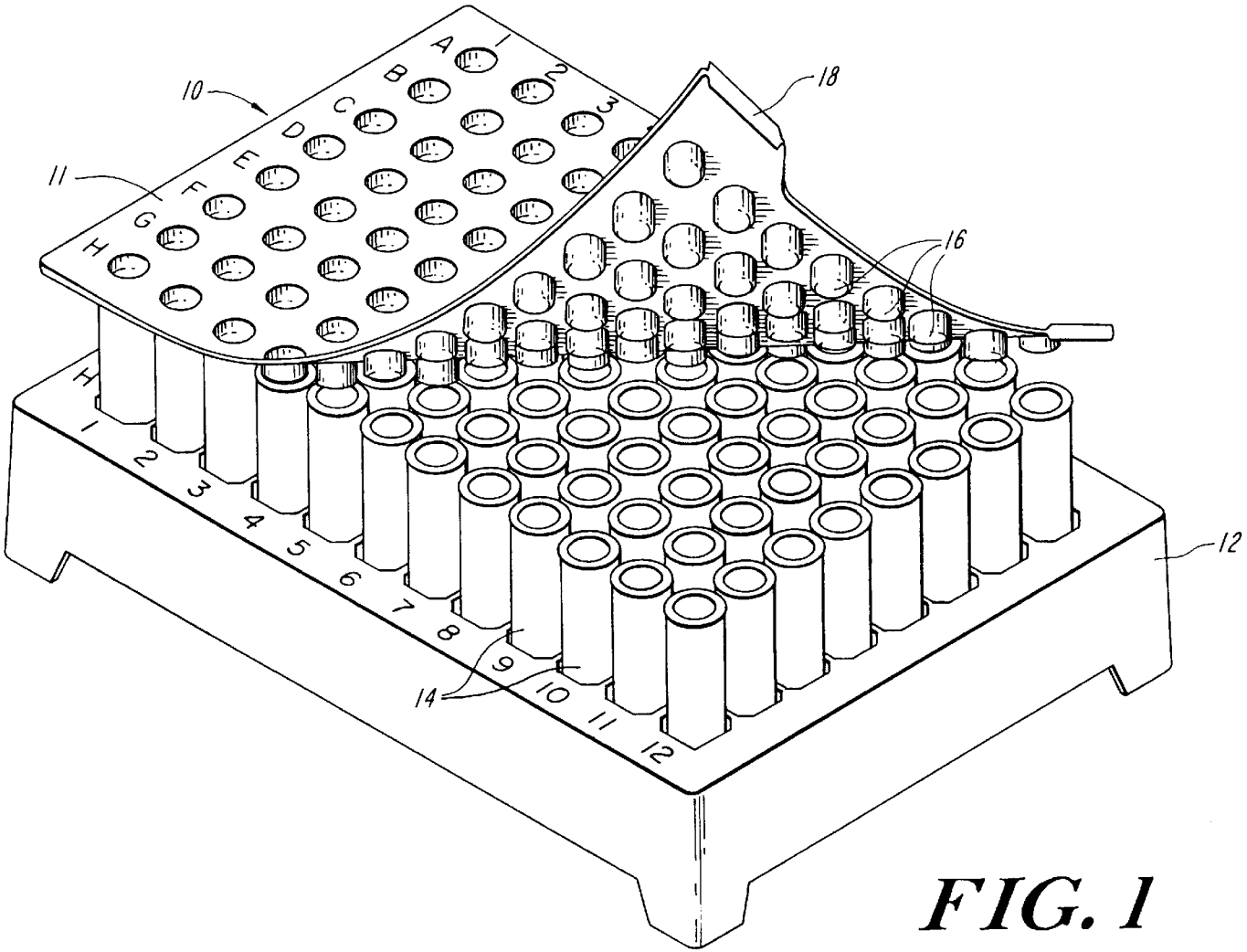
FIG. 1 is a perspective view of a cap mat in accordance with the present invention partially applied to an array of laboratory test tubes.

Referring initially to FIG. 1, a closure device in the form of a cap mat 10 is shown partially removed from a rack 12 of test tubes 14. The cap mat 10 includes a flexible cover 11 configured and dimensioned to overlie the test tubes 14. Hollow caps 16 in an ordered array are integrally formed with and depend from the cover 11. The caps 16 are positioned to enter the open ends of the test tubes 14 with an interference fit. The cap mat 10 is preferably transparent, and may be molded of a polymeric material such as ethylene vinyl acetate ("EVA") and may include a tab 18 at one edge to assist in its removal from the test tubes 14. As illustrated, the cap mat 10 may be configured to include ninety six caps 16 to close and seal a like number of rack-supported test tubes. Alternatively, the caps 16 may be provided in strip form, and they may be severable from their supportive strip or mat for application to individual tubes.

Figure 3:
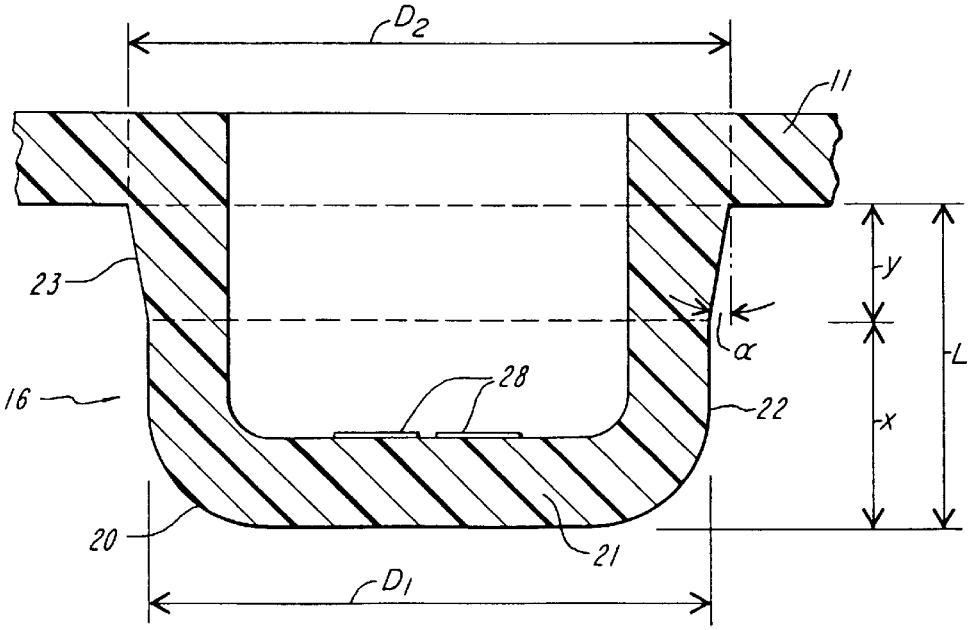
FIG. 3 is a sectional view on an enlarged scale of a single cap taken along line 3—3 of FIG. 2.

As can be best seen in FIG. 3, each cap 16 has a cup shaped nose 20 with a substantially flat bottom 21 joined to a cylindrical side wall 22 by a convex intermediate wall portion. The nose 20 has an axial length X, and is connected to the cover 11 by an intermediate wall section 23 having an axial length Y. The intermediate wall section 23 has an outer surface tapering inwardly at an angle $\alpha$ of approximately 10°. The axial length X of the cup shaped nose 20 is less than 75% and preferably only about 65% of the overall axial length L of the cap. The axial length Y of the intermediate wall section 23 is about one third the overall axial cap length L, with overall axial length L of the cap being approximately 3.5 times the thickness of the cover 11. The maximum outer diameter $D_1$ of the cup shaped nose is not more than 95% nor less than 92% of the maximum diameter $D_2$ of the tapering outer surface With reference to FIG. 5, it will be understood that stage I shows a cap 16 prior to insertion into the open end of a test tube 14, stage II shows a cap partially inserted, (or partially removed), and stage III shows a cap fully inserted. Stage III is illustrated on a further enlarged scale in FIG. 4.

Figure 4:
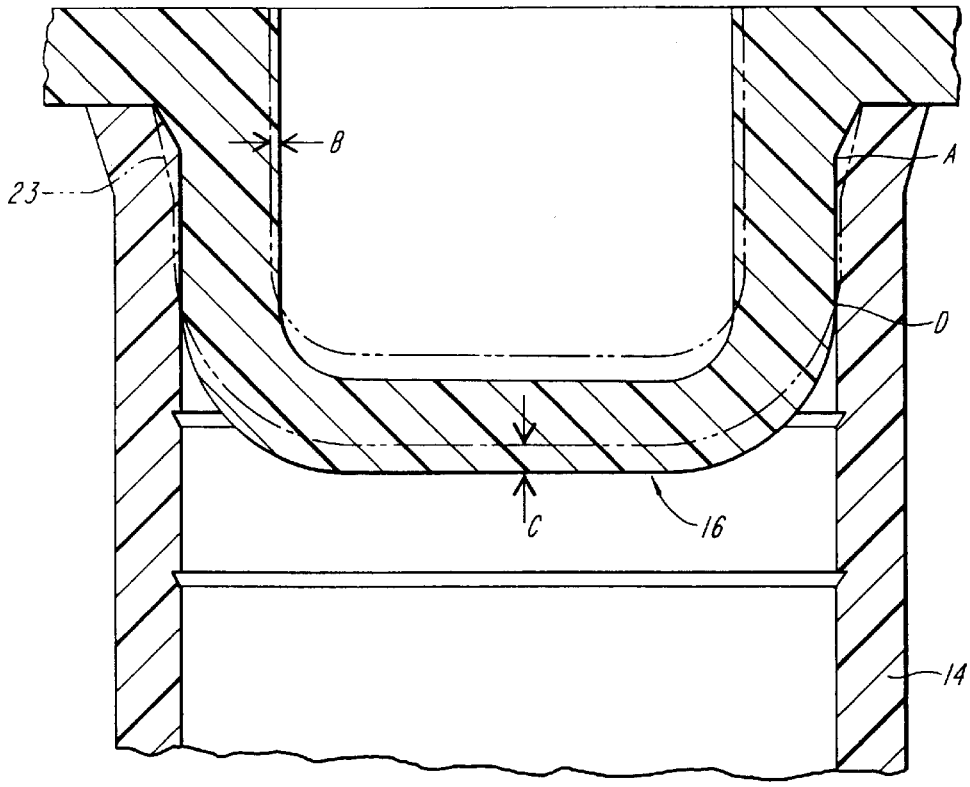
FIG. 4 is a sectional view showing the cap of FIG. 3 inserted into the open end of a test tube.
Figure 5:
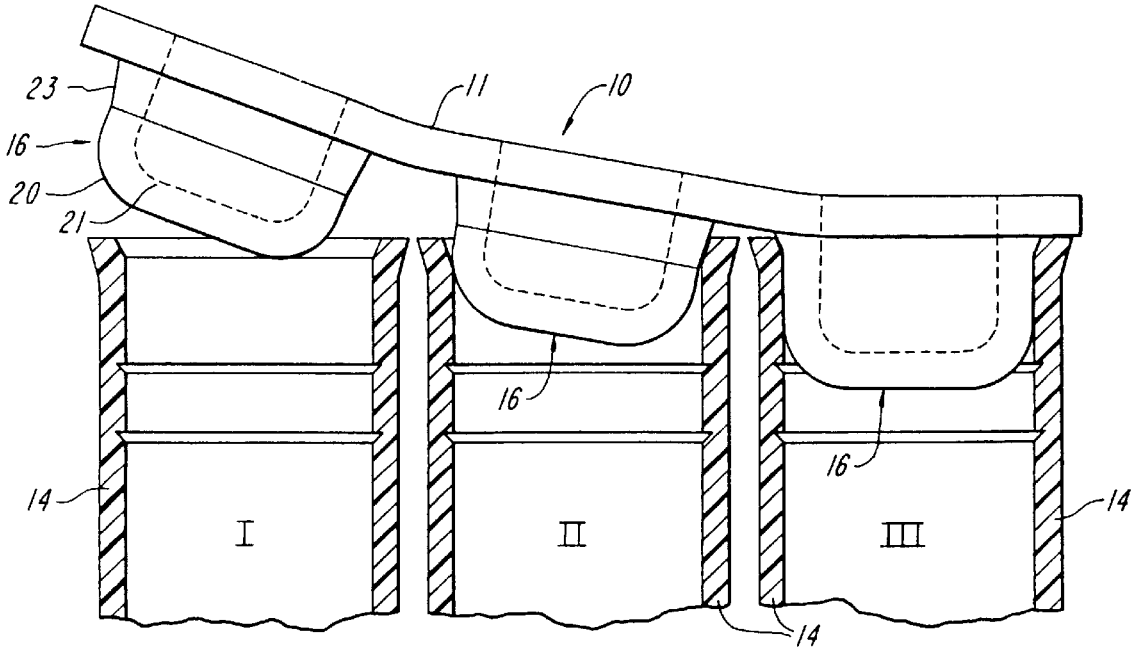
FIG. 5 is a view illustrating the application of a mat in accordance with the present invention to a series of test tubes.

As shown at stage II in FIG. 5, the cup shaped nose 20 serves to initially guide the cap into the open tube end. This occurs smoothly, with little if any attendant deformation of the cap. FIG. 4 shows that further entry of the cap to its fully inserted position (stage III in FIG. 5) produces an interference fit as at "A" between the inwardly tapered outer surface of intermediate wall section 23 and the beveled open end of the tube. This interference fit results in a thickening of the cap wall as at "B" and an axial lengthening of the cap as at C. Maximum compression and sealing occurs at A as the cap is pressed into its fully seated position, with some additional modest compression also occurring at "D". During removal, the tight seal at A is immediately broken with only slight relative upward twisting movement of the cover, resulting in the cap being lifted at an angle (stage II). This instantaneously relieves all stresses, allowing the cap to return to its original shape. The relatively shallow depth X of the nose portion 20 allows the cap to easily clear the upper edge of the tube, further facilitating removal. The relatively shallow depth L of the cap is also advantageous in that it maximizes the available storage volume of the tube.

Figure 2:
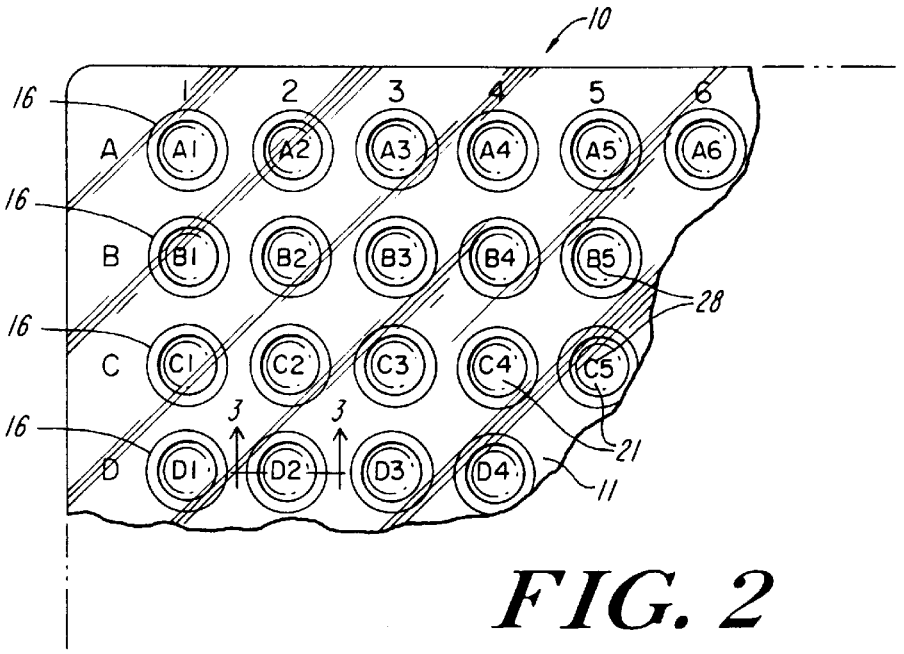
FIG. 2 is a partial plan view, on an enlarged scale, of the cap mat shown in FIG. 1.

With reference to FIG. 2, it will be seen that the bottoms 21 of the cup-shaped noses 20 may advantageously be provided with molded or printed indicia 28 corresponding to that provided at 26 along the edges of the rack 12.

Figure 6:
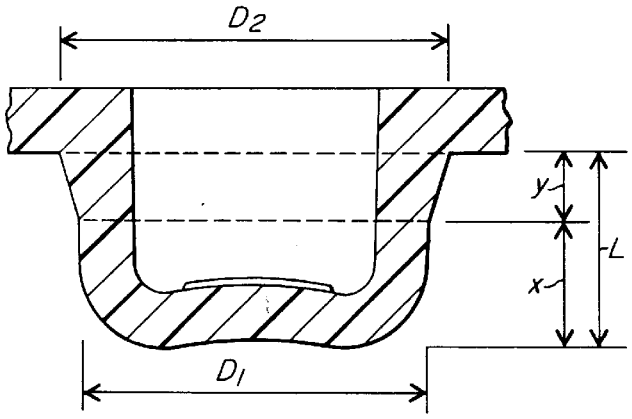
FIG. 6 is a view similar to FIG. 3 showing an alternative cap construction.

Alternatively, as depicted in FIG. 6, the cup shaped nose 20 may have a concave bottom 30. In this embodiment, the axial length Y of the intermediate wall section 23 is again approximately one third the overall axial cap length L. Here, the maximum outer diameter $D_1$ of the cup shaped nose is not more than about 97% nor less than about 94% of the maximum outer diameter $D_2$ of wall section 23.

Figure 7:
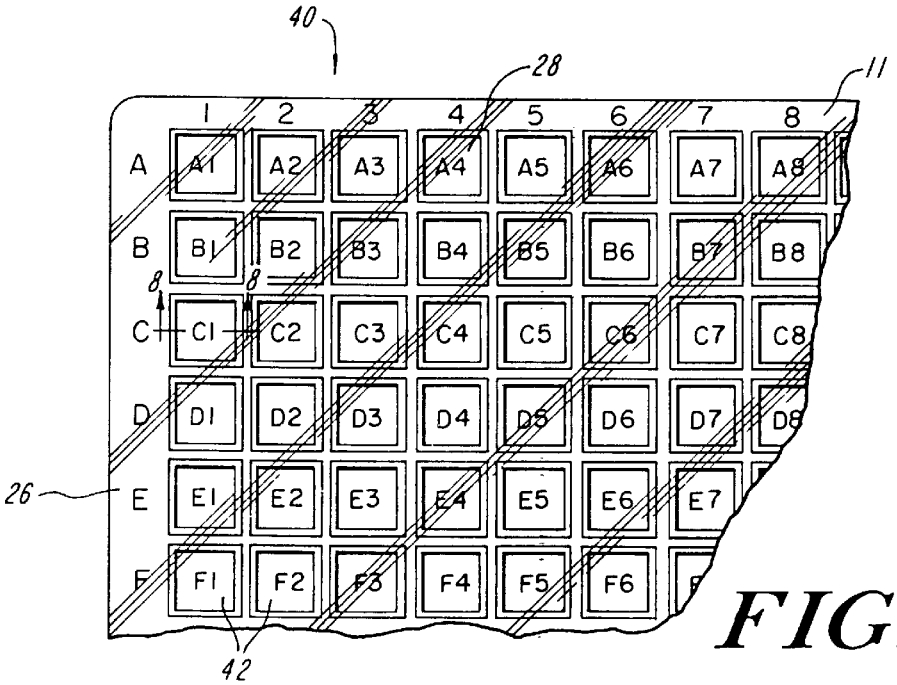
FIG. 7 is a view similar to FIG. 2 showing a cap mat with rectangular shaped caps.
Figure 8:
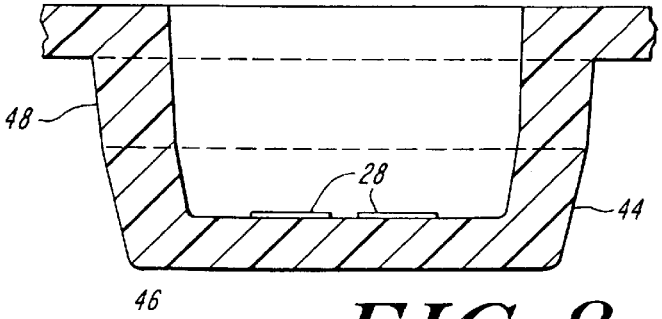
FIG. 8 is a sectional view on an enlarged scale taken along line 8—8 of FIG. 7.

A third embodiment is illustrated in FIGS. 7 and 8 wherein the mat 40 has caps 42 which are flat sided to define square cross sections. The square caps 40 are configured and dimensioned to be received in receptacles having square openings. Each cap 40 includes a four sided cup shaped nose 44 with a substantially flat bottom 46 joined to the cover 11 by planar walls having inwardly tapered outer surfaces 48. Indicia 28 may be molded or printed in each cap 42 to correspond to that which may be along the edge of a corresponding rack of test tubes.

The foregoing description has been limited to a specific embodiment of the invention. It will be apparent, however, that variations and modifications can be made to the invention, with the attainment of some or all of the advantages. Therefore, it is the object of the claims to cover all such variations and modifications as come within the true spirit and scope of the invention.

What is now claimed is:

1. A closure device for closing the open ends of an array of mutually spaced receptacles, said closure device comprising:

a flexible cover configured and dimensioned to overlie said receptacles; and an array of hollow caps formed integrally with and depending from said cover, said caps being positioned to enter and close the open ends of said receptacles, said caps having cup shaped noses with cylindrical side walls joined to said cover by intermediate wall sections, said intermediate wall sections having outer surfaces which taper inwardly from said cover to said cylindrical side walls and which are dimensioned to create singular interference fits with said receptacles within the open ends thereof.

2. The closure device as claimed in claim 1 wherein the open ends of the mutually spaced receptacles are circular.

3. The closure device as claimed in claim 2 wherein the caps are circular.

4. The closure device as claimed in claim 1 wherein the bottoms of said cup shaped noses are substantially flat.

5. The closure device as claimed in claim 1 wherein the bottoms of said cup shaped noses are indented.

6. The closure device as claimed in claim 3 wherein the maximum outer diameter of said cup shaped nose is not more than 95% of the maximum diameter of said tapering outer surface.

7. The closure device as claimed in claim 6 wherein the maximum outer diameter of said cup shaped nose is not less than 92% of the maximum diameter of said tapering outer surface.

8. The closure device as claimed in claim 1 wherein the axial length of said intermediate wall section is about one third the overall axial length of said cap.

9. The closure device as claimed in claim 1 wherein the outer surface of said intermediate wall section tapers inwardly at an angle of approximately 10°.

10. The closure device as claimed in claim 1 wherein said cover and said hollow caps are integrally molded from ethylene vinyl acetate.

11. The closure device as claimed in claim 1 wherein the axial length of said cup shaped nose is less than 75% of the overall length of said cap.

12. The closure device as claimed in claim 11 wherein the axial length of said cup shaped nose is approximate 65% of the overall length of said cap.

13. The closure device as claimed in claim 1 wherein the overall axial length of said cap is about 3.5 times the thickness of said cover.

14. The closure device as claimed in claim 1 wherein said caps are located at the intersections of mutually perpendicular columns and rows, said caps being distinguishable one from the other by reference to their respective intersecting columns and rows and wherein each cap includes indicia representative of said respective intersecting columns and rows.

15. The closure device as claimed in claim 1 wherein the overall axial length of said cap is about 3.5 times the thickness of said cover.

16. The closure device as claimed in claim 1 wherein the open ends of the mutually spaced receptacles are square.

17. The closure device as claimed in claim 1 wherein the caps are square.

* * * * *